US006305461B1

(12) United States Patent
Braswell

(10) Patent No.: US 6,305,461 B1
(45) Date of Patent: Oct. 23, 2001

(54) DROP LEG BOOSTER FOR CARBURETORS

(75) Inventor: David Braswell, Marana, AZ (US)

(73) Assignee: POW Engineering, Inc., Marana, AZ (US)

( * ) Notice: Subject to any disclaimer, the term of this patent is extended or adjusted under 35 U.S.C. 154(b) by 0 days.

(21) Appl. No.: 09/471,893

(22) Filed: Dec. 23, 1999

(51) Int. Cl.[7] ..... B22D 11/10; F02M 19/10

(52) U.S. Cl. ..... 164/465; 29/526.4; 29/527.6; 164/69.1; 164/477; 164/132; 261/23.2; 261/DIG. 12; 261/DIG. 39

(58) Field of Search ..... 261/23.2, 34.1, 261/78.1, DIG. 12, DIG. 56, DIG. 39, DIG. 55; 164/47, 131, 132, 464, 465, 477, 69.1; 29/527.6, 526.4

(56) References Cited

U.S. PATENT DOCUMENTS 1,838,418 * 12/1931 Le May ..... 164/47
2,771,282 * 11/1956 Olson et al. ..... 261/23.2
2,996,290 * 8/1961 Munden ..... 261/23.2 X
3,208,738 * 9/1965 Johnson ..... 261/23.2
3,454,264 * 7/1969 Sarto ..... 261/23.2
3,618,904 * 11/1971 Woods ..... 261/23.2 X
3,796,413 * 3/1974 Woods ..... 261/DIG. 39
3,841,612 * 10/1974 Freismuth et al. ..... 261/23.2
4,387,685 * 6/1983 Abbey ..... 261/DIG. 56
4,875,519 * 10/1989 Ishii et al. ..... 164/465
5,807,512 * 9/1998 Grant ..... 261/78.1 X
5,809,972 * 9/1998 Grant ..... 261/23.2 X
5,863,470 * 1/1999 Grant ..... 261/DIG. 12

* cited by examiner

*Primary Examiner*—Richard L. Chiesa
(74) *Attorney, Agent, or Firm*—Birdwell, Janke & Durando, PLC

(57) ABSTRACT

A booster equipped carburetor in which the venturi bores in the carburetor have an enhanced drop leg booster therein. The drop leg booster has a venturi orifice and a "bent" channel member. The channel member communicates fuel to the venturi orifice and positions the venturi orifice below a second end of the channel member within a venturi bore of the carburetor. The channel member preferably has smooth sides to assure consistent flow without undue turbulence.

5 Claims, 2 Drawing Sheets

DROP LEG BOOSTER FOR CARBURETORS

BACKGROUND OF THE INVENTION

The present invention relates to internal combustion engines and more particularly to carburetors for internal combustion engines.

While the present invention discusses the use of a "four-barrel" or four venturis within a carburetor, the invention is not so limited as those of ordinary skill in the art will readily appreciate.

The venturi within a carburetor is shaped to form streamlined air inlets that rapidly accelerate the air through the narrow venturi throat section. Air traveling fast experiences a large pressure drop, thereby creating a venturi vacuum. The higher the air flow going into the venturi, the larger the venturi suction.

Leaving the low pressure/high air velocity venturi throat, the air exits through a gently widening taper which reduces the air velocity to create a higher pressure zone.

A booster amplifies the suction signal of the main venturi found in the carburetor. This allows the fuel to be drawn more efficiently. Fuel and a small amount of air come up from the main well in the metering block to deliver a rich air emulsion from a center nozzle. It exits, like a froth of fuels, and leaves the booster surrounded by the venturi air, with which it mixes en route to the cylinders of the internal combustion engine.

It is clear that the efficiency of the booster directly affects the efficiency of the carburetor and hence the engine. The existing art for the manufacture of boosters does not take into account the affect that otherwise minor flaws can have on the overall affect.

It is clear that there is a need for a more durable and efficient drop leg booster for the creation of efficient assemblies.

SUMMARY OF THE INVENTION

This invention provides a booster equipped carburetor in which the venturi bores in the carburetor have an enhanced drop leg booster. The carburetor is generally a traditional carburetor; the drop leg booster of this invention provides enhanced fuel flow into the venturi bores of the carburetor.

The "drop legs" aspect of the present invention positions the booster's own venturi mechanism at the proper point within the venturi bore of the carburetor. In this context, the "drop leg" serves as both the conduit for the fuel and also as the support mechanism for the booster's venturi.

While some embodiments of the invention utilize two supporting "legs", the preferred embodiment of the invention employs a single "leg", thereby providing as little air flow disruption to the air-flow through the carburetor's venturi bore as possible.

The carburetor portion of the assembly uses at least one venturi bore (other embodiments use a dual bore carburetor). In the preferred embodiment, four venturi bores are employed by the carburetor. These venturi bores (together with the boosters) are used to create the desired fuel/air ratios for proper operation of the internal combustion engine.

In this context, the booster provides a consistent flow of fuel into a first venturi found on the booster itself.

Communication of the fuel to the booster's own venturi is accomplished through the use of a "bent" channel member. The channel member is secured to a fuel source (located in a wall of the carburetor or the venturi bore of the carburetor) at one end. This fuel flows in a "downward" direction to the booster's own venturi.

The channel member communicates fuel to the venturi orifice and positions the venturi orifice below the second end of said channel member within said venturi bore of said carburetor. The length and the angle of the channel member's "drop" is dictated by the carburetor's own design. Those of ordinary skill in the art appreciate how the position of the booster's venturi within the venturi bore of the carburetor affects the overall performance.

The performance of the booster is significantly improved by the method of manufacture of the booster itself. Within the invention's method of manufacture, the interior of the channel member has smooth sides to assure consistent flow without undue turbulence. Eddies created by an un-smooth or stepped channel walls are avoided. The smooth wall nature of the invention's channel assure that a consistent fuel flow is assured and that changes in flow rates do not create unexpected results or performance from the booster.

Another advantage that the present invention creates is the elimination of a "stress riser" at the intersection of the two legs. This provides for a more durable and stable leg arrangement which is less likely to break during use.

In this context, the booster is manufactured using die casting techniques. Die casting is a metal casting process in which molten metal is forced under pressure into a mold. Typically the two types of die cast methods are hot-chamber and cold-chamber.

The die for the booster blank is also equipped with a channel insert (core pin) which extends through the primary drop leg section and partially into the secondary portion of the drop leg. The insert is shaped to mate with a drill bit (performed after the blank has hardened and been removed from the die) which is used to create the segment extending from the lower portion of the necking of the booster's venturi through the secondary portion of the drop leg.

In this manner, a channel is created which extends from the fuel source, through the primary leg (both created during the casting operation), through the secondary leg (drilled after the casting), to the booster venturi. Since the die cast channel is shaped to mate with the drilled channel smoothly, eddies and turbulence are minimized, providing for a consistent operation by the booster.

The invention, together with various embodiments thereof, will be more fully explained by the accompanying drawings and the following descriptions thereof.

DRAWINGS IN BRIEF

FIGS. 1A, 1B, and 1C illustrate the preferred production of the invention's drop leg booster.

DRAWINGS IN DETAIL

Figure 1A:
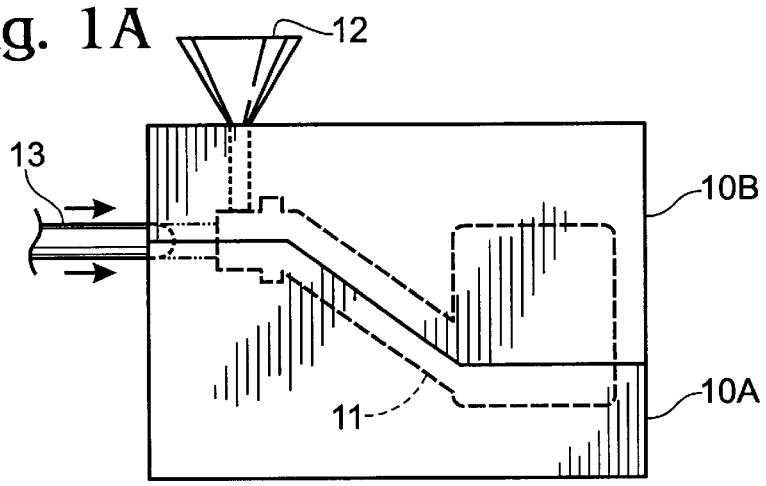
Figure 1B:
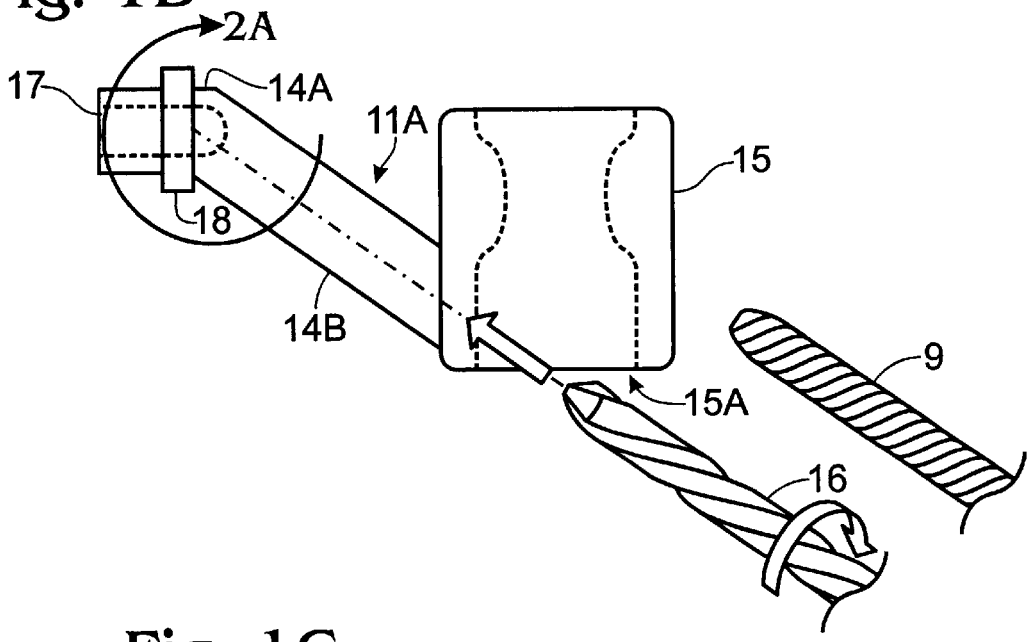
Figure 1C:
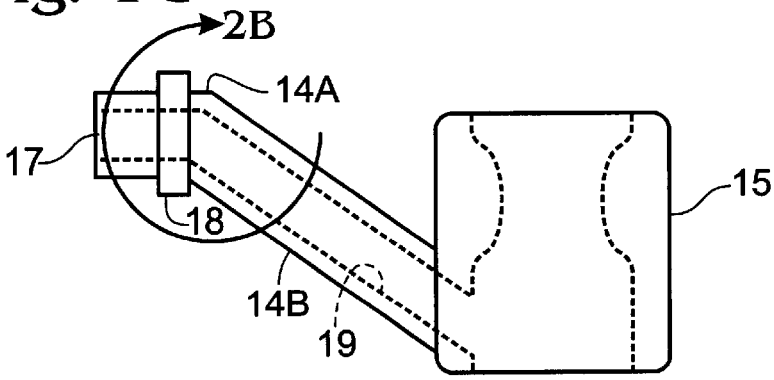

FIGS. 1A, 1B, and 1C illustrate the preferred production of the invention's drop leg booster.

Referring to FIG. 1A, two parts (10A and 10B) form the casting mold which has a cavity 11 therein formed as the general layout for a drop leg booster. Prior to the introduction of metal into the casting mold, core pin 13 is inserted into the mold.

Molten metal is introduced into cavity 11 via opening 12.

When the metal has set, insert 13 is withdrawn and the casting mold 10A and 10B is opened to reveal the drop leg booster blank 11A shown in FIG. 1B.

Blank 11A has a first leg portion 14A and a second leg portion 14B connecting with booster venturi 15. A cast channel 17 was formed in the first leg 14A (and also in a portion of the second leg 14B) during the casting operation outlined in FIG. 1A.

Connector plate 18 was also formed during the casting procedure and is positioned on first leg portion 14A. Connector plate 18 facilitates a press fitting between the finished booster and the carburetor.

In one embodiment of the invention, a de-burring tool 9 is inserted into the channel formed by drill 16 to assure the lack of burrs both within the drilled channel and also at the interface with channel 17. De-burring of the channel is accomplished through a variety of mechanisms including the passage of an abrasive (such as plastic particles) to abrade the walls into a smooth channel.

At this stage of production, a channel is drilled from the low pressure side 15A of booster venturi 15 using drill 16. This channel is formed within second leg portion 14B. In this context, the venturi has an upper throat section followed by a sudden widening of the channel. The drill passage is through this widened section allowing fuel to be drawn through the channel into the booster venturi.

FIG. 1C illustrates the completed drop leg booster 9 with its: first leg portion 14A, second leg portion 14B, booster venturi 15, and connecting channel 17/19 which will be used to communicate fuel to the low pressure side of booster venturi 15.

Figure 2A:
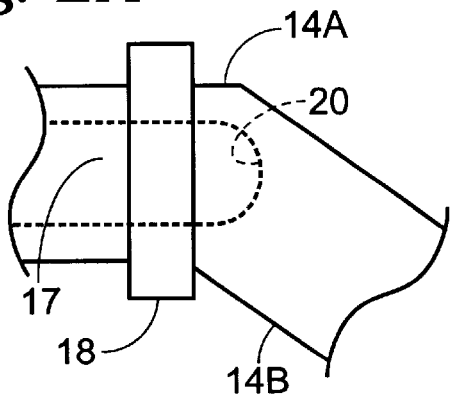
FIGS. 2A and 2B are close up views of the elbow arrangement for the preferred drop leg booster.
Figure 2B:
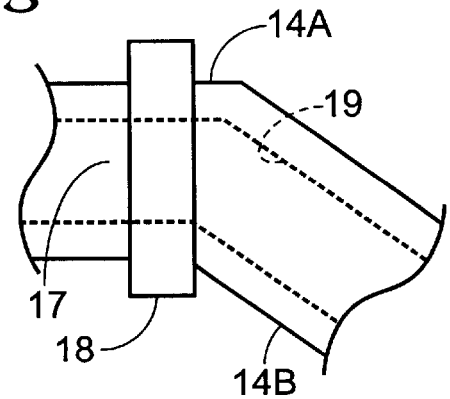

FIGS. 2A and 2B are close up views of the elbow arrangement for the preferred drop leg booster.

The elbow between leg portion 14A and 14B is shown in these figures. FIG. 2A illustrates the state when the cast blank booster has been removed. Leg portion 14A has a cast channel 17 formed therein. This cast channel 17 extends all the way through leg portion 14A and partially into leg portion 14B.

Note the distal end 20 of cast channel 17 which has been shaped to create the beginnings of the bend which the channel must achieve.

FIG. 2B illustrates how the mating of cast channel 17 with the drilled channel 19. The distal end shape 20 creates a smooth transition between the two channels forming a smooth, continuous channel which is devoid of "steps" or "burrs" which weaken the interconnection point and also create eddies and turbulence within the fuel flow.

It is this smooth transition which provides an exemplary and consistent operation for the invention's drop leg booster.

Figure 3A:
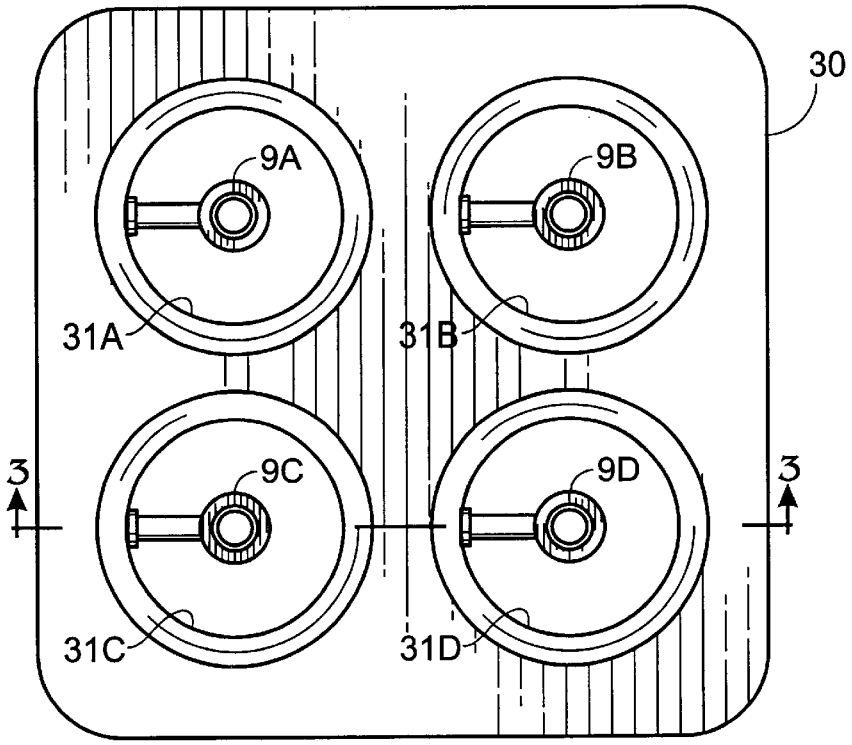
FIGS. 3A and 3B are top and side views of the preferred embodiment placed within a carburetor.
Figure 3B:
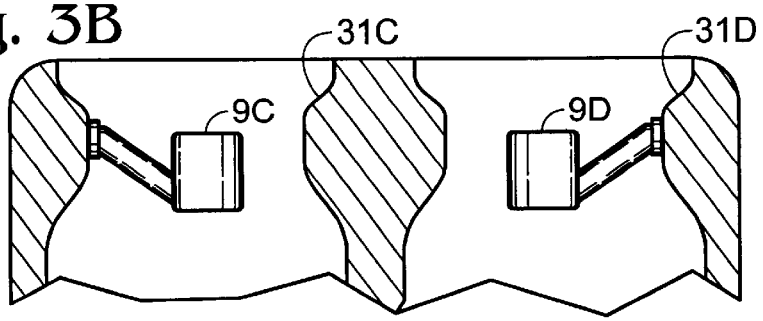

FIGS. 3A and 3B are top and side views of the preferred embodiment placed within a carburetor.

The assembly includes carburetor 30 which, in this illustrations, has four venturi bores 31A, 31B, 31C, and 31D. Positioned within each of these venturi bores is a single drop leg booster 9A, 9B, 9C, and 9D.

The resulting assembly forms a carburetor system which is much more responsive and provides for a consistent operation of the internal combustion engine.

It is clear that the present invention provides a durable and efficient drop leg booster which result in greatly enhanced carburetor/booster assemblies.

What is claimed is:

1. A method of forming a drop leg booster for a carburetor comprising the steps of:

a) forming a blank booster having a leg portion with a first and a second segment, said first segment forming an angle relative to said second segment, said first segment having a die-cast formed channel therein, a first end of said die-cast channel extending partially into said second segment, said second segment connected to a venturi orifice; and, b) drilling a channel through said venturi orifice and said second segment to form a channel connecting with said first end of said die-cast channel.

2. The method forming a drop leg booster according to claim 1, wherein the step of drilling a channel includes the step of aligning a drill to extend from a low pressure side of said venturi orifice to enter said second segment.

3. The method of forming a drop leg booster according to claim 2, further comprising the step of, after the step of drilling a channel, de-burring said drop leg booster.

4. The method of forming a drop leg booster according to claim 1, further comprising the step of assuring that, for the length of said leg portion, said leg portion has substantially uniform cross-section.

5. A method of forming a drop leg booster blank comprising the steps of:

a) closing a die-cast mold, said mold shaped as an exterior of a drop leg booster having a venturi orifice and a leg portion;

b) pressing a core pin into the leg portion;

c) filling said mold with a chosen material;

d) allowing said material to harden;

e) removing said core pin; and, f) removing the hardened material from said mold.

* * * * *